US006453711B2

(12) United States Patent
Rhodes et al.

(10) Patent No.: US 6,453,711 B2
(45) Date of Patent: Sep. 24, 2002

(54) FLAT TURBULATOR FOR A TUBE AND METHOD OF MAKING SAME

(75) Inventors: Eugene E. Rhodes, Belleville; Greg Whitlow, Whitmore Lake; Wen F Yu, Ann Arbor, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/761,047

(22) Filed: Jan. 15, 2001

Related U.S. Application Data

(62) Division of application No. 09/345,375, filed on Jul. 1, 1999, now Pat. No. 6,213,158.

(51) Int. Cl.[7] ..... B21D 13/04; B21D 28/02; B23P 15/26

(52) U.S. Cl. ..... 72/180; 72/186; 72/326; 72/379.6; 29/890.049; 29/890.053; 29/590.054

(58) Field of Search ..... 72/325, 326, 186, 72/180, 379.6; 29/890.049, 890.053, 890.054; 138/171

(56) References Cited

U.S. PATENT DOCUMENTS

| | | | | | |
|---|---|---|---|---|---|
| 493,791 | A | * | 3/1893 | Schurig | |
| 2,360,123 | A | | 10/1944 | Gerstung et al. | |
| 2,488,615 | A | | 11/1949 | Arnold | |
| 2,757,628 | A | | 8/1956 | Johnston | |
| 2,778,606 | A | | 1/1957 | Lloyd et al. | |
| 3,191,418 | A | | 6/1965 | Modine | 72/196 |
| 3,542,124 | A | | 11/1970 | Manfredo et al. | 165/166 |
| 3,650,017 | A | | 3/1972 | Gal | |
| 3,665,745 | A | | 5/1972 | Bion | 72/186 |
| 3,766,873 | A | | 10/1973 | Narog | 72/186 |
| 3,768,149 | A | | 10/1973 | Swaney, Jr. | |
| 3,825,061 | A | | 7/1974 | Bathla | 165/166 |
| 3,960,208 | A | | 6/1976 | Anthony et al. | |
| 3,999,924 | A | * | 12/1976 | Tanaka | |
| 4,170,122 | A | | 10/1979 | Cowell | 72/186 |
| 4,172,548 | A | | 10/1979 | Nakamura | |
| 4,464,920 | A | | 8/1984 | Stoehr et al. | 72/186 |
| 4,470,452 | A | * | 9/1984 | Rhodes | |
| 4,501,321 | A | | 2/1985 | Real et al. | |
| 4,510,786 | A | * | 4/1985 | Strangward | |
| 4,522,860 | A | * | 6/1985 | Scott | |
| 4,586,964 | A | | 5/1986 | Finnegan et al. | |
| 4,737,200 | A | | 4/1988 | Herchenroeder | |
| 4,804,041 | A | * | 2/1989 | Hasegawa | |
| 5,078,207 | A | | 1/1992 | Asano et al. | |

(List continued on next page.)

FOREIGN PATENT DOCUMENTS

| | | | | |
|---|---|---|---|---|
| CA | 619325 | | 5/1961 | |
| FR | 1521595 | | 3/1968 | |
| GB | 22533 | * | 3/1913 | 72/325 |
| JP | 41-12488 | * | 7/1966 | 72/186 |
| JP | 57-198995 | | 12/1982 | |
| JP | 2-151379 | | 6/1990 | |
| SU | 1274124 | * | 8/1985 | 72/186 |

*Primary Examiner*—Daniel C. Crane
(74) *Attorney, Agent, or Firm*—Larry I. Shelton

(57) ABSTRACT

A tube and turbulator and method of making the same for a heat exchanger including a base, a top spaced from and opposing the base, a first side interposed between the base and the top along one side thereof, and a second side interposed between the base and the top along another side thereof. The base, top, first side and second side form a channel. The second side is triple hemmed such that ends of the base and the top are disposed within the channel. A flat turbulator may be disposed inside the tube and includes a base extending laterally and longitudinally in a strip. The flat turbulator also includes a plurality of corrugations spaced laterally along the base and extending longitudinally and generally perpendicular to the base in an alternating manner. The corrugations are rolled in a direction parallel to a longitudinal axis of the strip.

11 Claims, 5 Drawing Sheets

U.S. PATENT DOCUMENTS

| | | | | | |
|---|---|---|---|---|---|
| 5,105,540 | A | | 4/1992 | Rhodes | 29/890.043 |
| 5,295,302 | A | | 3/1994 | Takai et al. | |
| 5,330,090 | A | | 7/1994 | Iwai | 228/224 |
| 5,372,188 | A | | 12/1994 | Dudley et al. | 29/890.049 |
| 5,377,901 | A | | 1/1995 | Rungta et al. | 228/183 |
| 5,398,864 | A | | 3/1995 | Eichhorn et al. | |
| 5,491,997 | A | | 2/1996 | Ogawa | 72/177 |
| 5,547,517 | A | | 8/1996 | Iwai | |
| 5,682,784 | A | | 11/1997 | Stoynoff, Jr. | 72/186 |
| 5,890,288 | A | * | 4/1999 | Rhodes | |
| 6,032,503 | A | * | 3/2000 | Grippe | |
| 6,129,147 | A | * | 10/2000 | Dumetz | |
| 6,213,158 | B1 | | 4/2001 | Rhodes et al. | |

* cited by examiner 30
34
36
32
24

26
28

26
24
26
28
24

28
26

24
28
28
24

26
28
24

92
26
24

92
26
24

FLAT TURBULATOR FOR A TUBE AND METHOD OF MAKING SAME

This application is a division of Ser. No. 09/345,375, filed Jul. 1, 1999, now U.S. Pat. No. 6,213,158.

BACKGROUND OF THE INVENTION

1. Field of the Invention

The present invention relates generally to heat exchangers for motor vehicles and, more specifically, to a flat turbulator for a tube and method of making same for a heat exchanger in a motor vehicle.

2. Description of the Related Art

It is known to provide a tube for a heat exchanger such as an oil cooler in a motor vehicle. The tube typically carries a first fluid medium in contact with its interior while a second fluid medium contacts its exterior. Typically, the first fluid medium is oil and the second fluid medium is air. Where a temperature difference exists between the first and second fluid mediums, heat will be transferred between the two via heat conductive walls of the tube.

It is also known to provide corrugated fins or ribs in the interior of the tube to increase the surface area of conductive material available for heat transfer to cause turbulence of the fluid carried in the interior of the tube and to increase the burst strength of the tube. One known method of making such a tube is to physically insert a corrugated fin into the generally flattened tube after the tube has been manufactured. This is an extremely difficult process since the corrugated fin to be inserted into the tube is extremely thin and subject to deformation during the insertion process.

It is also known to produce a corrugated fin or turbulator by a stamping process. An example of such a turbulator is disclosed in U.S. Pat. No. 5,560,425. In this patent, the turbulator is made by stamping in a direction parallel to the fluid flow or strip direction of the turbulator and has corrugations in a direction perpendicular to the direction of the flow of the fluid or strip direction.

Although the above turbulators have worked well, they suffer from the disadvantage that the stamping process does not have a high production through put. Another disadvantage of these turbulators is that the turbulators are inserted after the tube is made. Therefore, there is a need in the art to provide a tube with a flat turbulator and method of making same for a heat exchanger of a motor vehicle that overcomes these disadvantages.

SUMMARY OF THE INVENTION

Accordingly, the present invention is a tube for a heat exchanger including a base, a top spaced from and opposing the base, a first side interposed between the base and the top along one side thereof, and a second side interposed between the base and the top along another side thereof. The base, top, first side and second side form a channel. The second side is triple hemmed such that ends of the base and the top are disposed within the channel.

Also, the present invention is a flat turbulator for a heat exchanger including a base extending laterally and longitudinally in a strip. The flat turbulator also includes a plurality of corrugations spaced laterally along the base and extending longitudinally and generally perpendicular to the base in an alternating manner. The corrugations are rolled in a direction parallel to a longitudinal axis of the strip.

Further, the present invention is a method of making a flat turbulator for a heat exchanger. The method includes the steps of providing a generally planar strip having a base extending laterally and longitudinally. The method also includes the step of forming a plurality of corrugations spaced laterally along said base and extending generally perpendicular to said base in an alternating manner such that the corrugations extend in a direction parallel to a longitudinal axis of the strip.

Additionally, the present invention is a method of making a tube for a heat exchanger. The method includes the steps of providing a planar sheet having a generally planar base and a pair of terminal ends along a longitudinal length thereof and folding each of the terminal ends of the sheet to form a triple hem flange. The method includes the step of folding each of the terminal ends of the sheet toward one another until they meet to form a base, a top opposing the base, a first side interposed between the top and base and a second side interposed between said base to form a channel with free ends of the triple hem flange on each terminal end being disposed in the channel.

One advantage of the present invention is that a tube with a flat turbulator for a heat exchanger such as an oil cooler is provided for a motor vehicle for cooling liquid oil. Another advantage of the present invention is that the tube with the flat turbulator tube is more economical to manufacture with precise dimensional control. Yet another advantage of the present invention is that the tube is triple-hemmed to provide extra strength. Still another advantage of the present invention is that a method of making a flat turbulator is provided along with a method of making a tube with the flat turbulator. A further advantage of the present invention is that the method of making the flat turbulator uses roll forming to increase production through put. Yet a further advantage of the present invention is that the method of making the flat turbulator has the direction of roll forming the same as the strip or fluid direction such that the corrugations are perpendicular to the strip direction.

Other features and advantages of the present invention will be readily appreciated, as the same becomes better understood, after reading the subsequent description taken in conjunction with the accompanying drawings.

DESCRIPTION OF THE PREFERRED EMBODIMENT(S)

Figure 1:
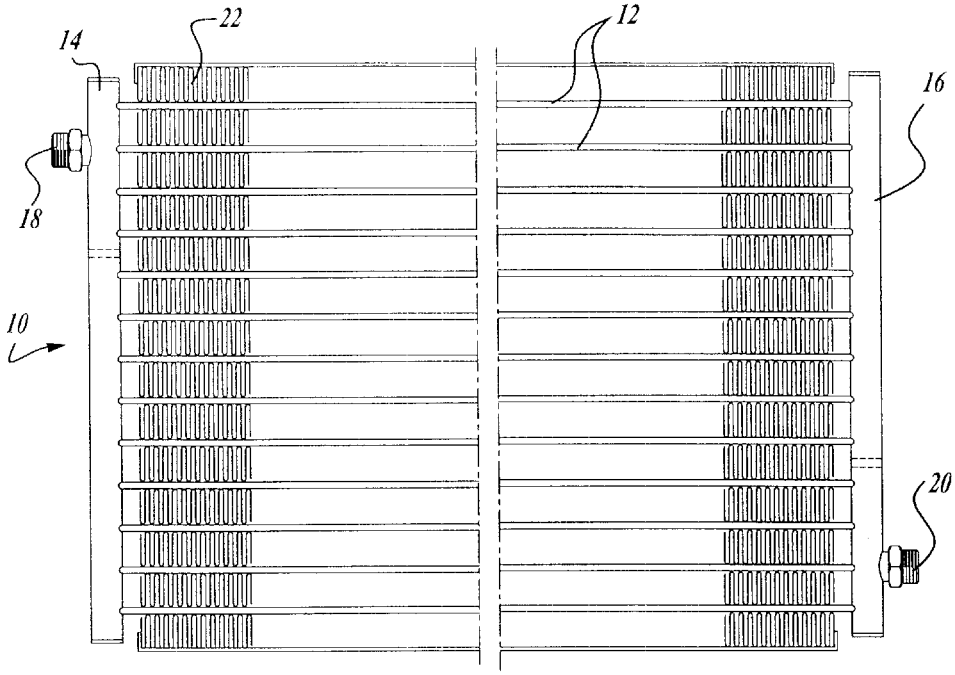
FIG. 1 is an elevational view of a tube with a flat turbulator, according to the present invention, illustrated in operational relationship with a heat exchanger of a motor vehicle.

Referring to the drawings and in particular FIG. 1, one embodiment of a heat exchanger 10 for a motor vehicle (not shown), such as an oil cooler, evaporator, or condenser, is shown. The heat exchanger 10 includes a plurality of generally parallel tubes 12, according to the present invention, extending between oppositely disposed headers 14,16. The heat exchanger 10 includes a fluid inlet 18 for conducting cooling fluid into the heat exchanger 10 formed in the header 14 and an outlet 20 for directing fluid out of the heat exchanger 10 formed in the header 16. The heat exchanger 10 also includes a plurality of convoluted or serpentine fins 22 attached an exterior of each of the tubes 12. The fins 22 are disposed between each of the tubes 12. The fins 22 serve as a means for conducting heat away from the tubes 12 while providing additional surface area for convective heat transfer by air flowing over the heat exchanger 10. It should be appreciated that, except for the tube 12, the heat exchanger 10 is conventional and known in the art. It should also be appreciated that the tube 12 could be used for heat exchangers in other applications besides motor vehicles.

Figure 2:
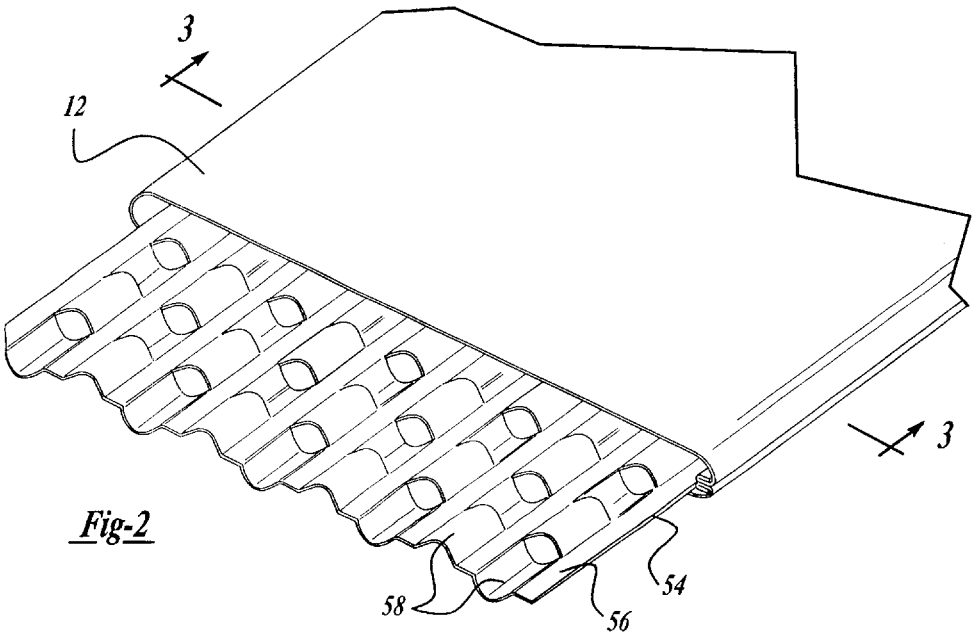
FIG. 2 is an enlarged perspective view of the tube with the flat turbulator of FIG. 1.
Figure 3:
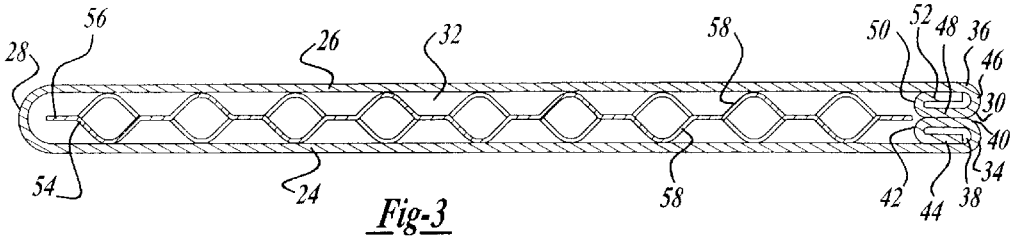
FIG. 3 is a sectional view taken along line 3—3 of FIG. 2.

Referring to FIGS. 2 and 3, the tube 12 extends longitudinally and is substantially flat. The tube 12 includes a base 24 being generally planar and extending laterally. The tube 12 also includes a top 26 spaced from the base 24 a predetermined distance and opposing each other. The top 26 is generally planar and extends laterally. The tube 12 includes a first side 28 interposed between the base 24 and the top 26 along one side thereof. The first side 28 is generally arcuate in shape. The tube 12 also includes a second side 30 interposed between the base 24 and the top 26 along the other side and opposing the first side 28 to form a channel 32. The second side 30 is generally arcuate in shape.

The second end 30 is formed by triple hemming a first end 34 of the base 24 and a second end 36 of the top 26. The first end 34 has a first transition portion 38 that is generally arcuate in shape and has a first flange portion 40 extending laterally toward the channel 32 and generally parallel to the base 24. The first end 34 also has a second transition portion 42 that is generally arcuate in shape and has a second flange portion 44 extending laterally away from the channel 32 and generally parallel to the base 24. The second flange portion 44 abuts the first flange portion 40. It should be appreciated that the second flange 44 is tucked under the first flange 40 such that its free end is disposed in the channel 32 and not exposed to the exterior of the tube 12.

The second end 36 has a first transition portion 46 that is generally arcuate in shape and has a first flange portion 48 extending laterally toward the channel 32 and generally parallel to the top 26. The second end 36 also has a second transition portion 50 that is generally arcuate in shape and has a second flange portion 52 extending laterally away from the channel 32 and generally parallel to the top 26. The second flange portion 52 abuts the first flange portion 48. It should be appreciated that the second flange portion 52 is tucked under the first flange portion 48 such that its free end is disposed in the channel 32 and not exposed to the exterior of the tube 12.

The first side 28 has a single wall thickness while the second side 30 has a multiple wall thickness for extra strength against stone chips while driving the motor vehicle. The tube 12 is made of a metal material such as aluminum or an alloy thereof and has a cladding on its inner and outer surfaces for brazing. It should be appreciated that the triple-hemmed second side 30 provides precise dimensional control for the channel 32 of the tube 12.

The tube 12 includes a generally flat turbulator 54, according to the present invention, disposed within the channel 32 of the tube 12. In the embodiment illustrated, the flat turbulator 54 has a generally planar base 56 extending laterally a predetermined distance and longitudinally in the form of a strip. The base 56 has a predetermined thickness such as between approximately 0.152 mm to approximately 0.304 mm. The flat turbulator 54 also has a plurality of corrugations 58 spaced laterally along the base 56 and extending longitudinally to turbulate fluid flow through the channel 32. The corrugations 58 extend longitudinally a predetermined distance such as between approximately 2.5 mm to approximately 7.0 mm in a strip or fluid flow direction. The corrugations 58 are spaced laterally a predetermined distance such as 0.76 mm. The corrugations 58 also extend generally perpendicular to a plane of the base 56 a predetermined distance such as 1.42 mm. The corrugations 58 that are spaced laterally extend perpendicular to the plane of the base 56 in an alternating pattern such that one of the corrugations 58 extends upwardly and a laterally adjacent corrugation 58 extends downwardly. The corrugations 58 that are spaced laterally in a row are offset from an adjacent longitudinal row of laterally spaced corrugations 58 such that in a longitudinal direction one of the corrugations extends upwardly and the longitudinally adjacent corrugation 58 extends downwardly. The corrugations 58 are formed by roll forming the base 56 in a direction along its longitudinal length to be described. The flat turbulator 54 is made of a metal material such as aluminum or an alloy thereof and has a cladding on its surfaces for brazing the flat turbulator 54 to the tube 12. It should be appreciated that the corrugations 58 are brazed to the top 26 and base 24 of the tube 12. It should also be appreciated that the flat turbulator 54 is optional and that the tube 12 may be used with other types of turbulators if desired.

Figure 4:
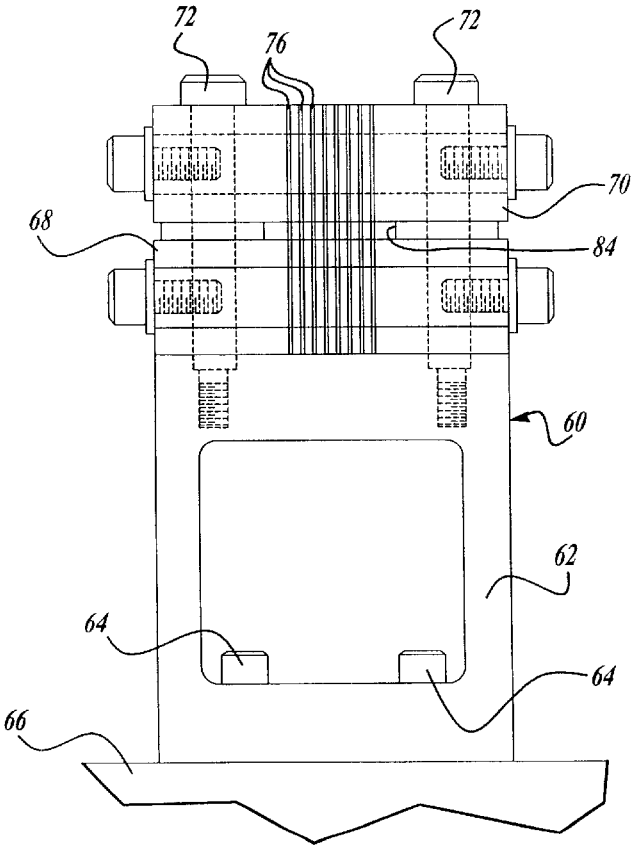
FIG. 4 is a side view of an apparatus for making the flat turbulator of FIG. 2.
Figure 5:
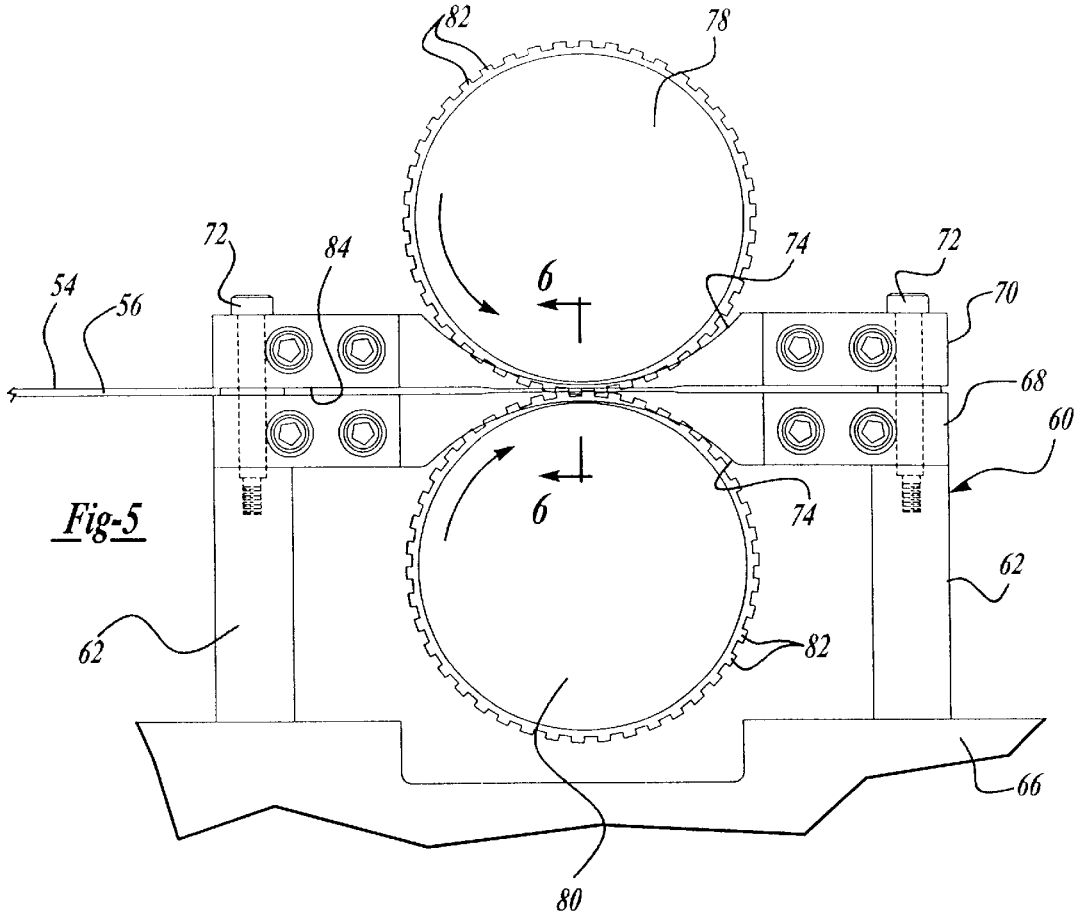
FIG. 5 is a front view of the apparatus for making the flat turbulator of FIG. 2.
Figure 6:
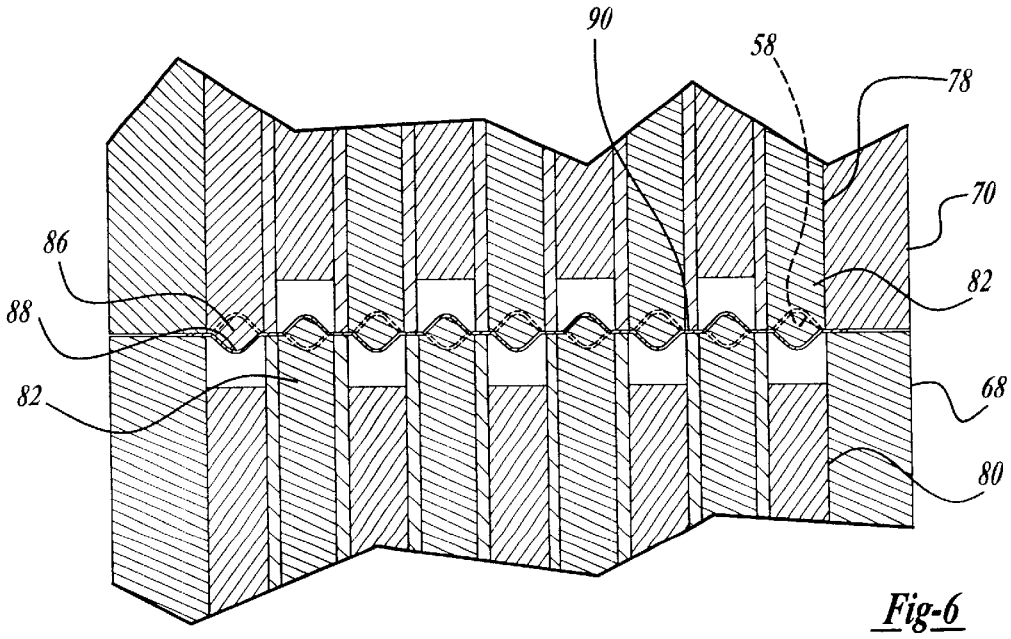
FIG. 6 is a sectional view taken along line 6—6 of FIG. 5.

Referring to FIGS. 4 through 6, an apparatus, generally indicated at 60, is shown for making the flat turbulator 54. The apparatus 60 includes a pair of support members 62 spaced longitudinally and extending vertically. The support members 62 are secured by suitable means such as fasteners 64 to a support surface 66. The apparatus 60 also includes a first or lower stripper plate 68 disposed adjacent the support members 62 and a second or upper stripper plate 70 disposed adjacent the lower stripper plate 68. The lower and upper stripper plates 68 and 70 are secured to the support members 62 by suitable means such as fasteners 72. The stripper plates 68 and 70 include a recess 74 being generally arcuate in shape with a plurality of channels 76 spaced laterally and extending longitudinally. In the embodiment illustrated, there are nine channels 76 spaced laterally a predetermined distance such as 0.0775 inches. The channels 76 have a predetermined width such as 0.025 inches for teeth of rollers to be described.

As illustrated in FIGS. 5 and 6, the apparatus 60 includes a pair of rollers such as an upper roller 78 and a lower roller 80 operatively connected to supporting structure (not shown). The upper roller 78 and lower roller 80 are generally circular in shape and have a plurality of teeth 82 extending radially and circumferentially and are spaced circumferentially. The upper roller 78 is disposed in the recess 74 of the upper stripper plate 70 such that a portion of the teeth 82 are disposed in the channels 76 of the upper stripper plate 70. The lower roller 80 is disposed in the recess 74 of the lower stripper plate 68 such that a portion of the teeth 82 are disposed in the channels 76 of the lower stripper plate 68. The base 56 of the flat turbulator 54 is fed into a slot or channel 84 between the upper stripper plate 70 and the lower stripper plate 68 in a longitudinal direction, which is the rolling direction for the upper and lower rollers 78 and 80.

As illustrated in FIG. 6, the teeth 82 of the upper and lower rollers 78 and 80 have a protruding or male portion 86.

The male portion 86 is generally arcuate in cross-sectional shape to form the corrugation 58 of the flat turbulator 54 in one direction to an arcuate or loop shape. The rollers 78 and 80 also have a recessed or female portion 86 disposed circumferentially and laterally between the teeth 82. The female portion 88 is generally arcuate in cross-sectional shape to form the corrugation 58 of the flat turbulator 54 in the opposite direction to an arcuate or loop shape. The rollers 78 and 80 have a generally flat portion 90 disposed laterally between the teeth 82 to maintain the flat shape of the base 56 of the turbulator 54. It should be appreciated that the male portion 86 and female portion 88 on the rollers 78 and 80 engage each other to form the corrugations 58 of the flat turbulator 54 and the flat portion or base 56 between the corrugations 58 provide strength and allow a finger (not shown) to strip the flat turbulator 54 to form a coil or roll.

Figures 7A, 7B, 7C, 7D, 7E, 7F, 7G, 7H, 7I, 7J:
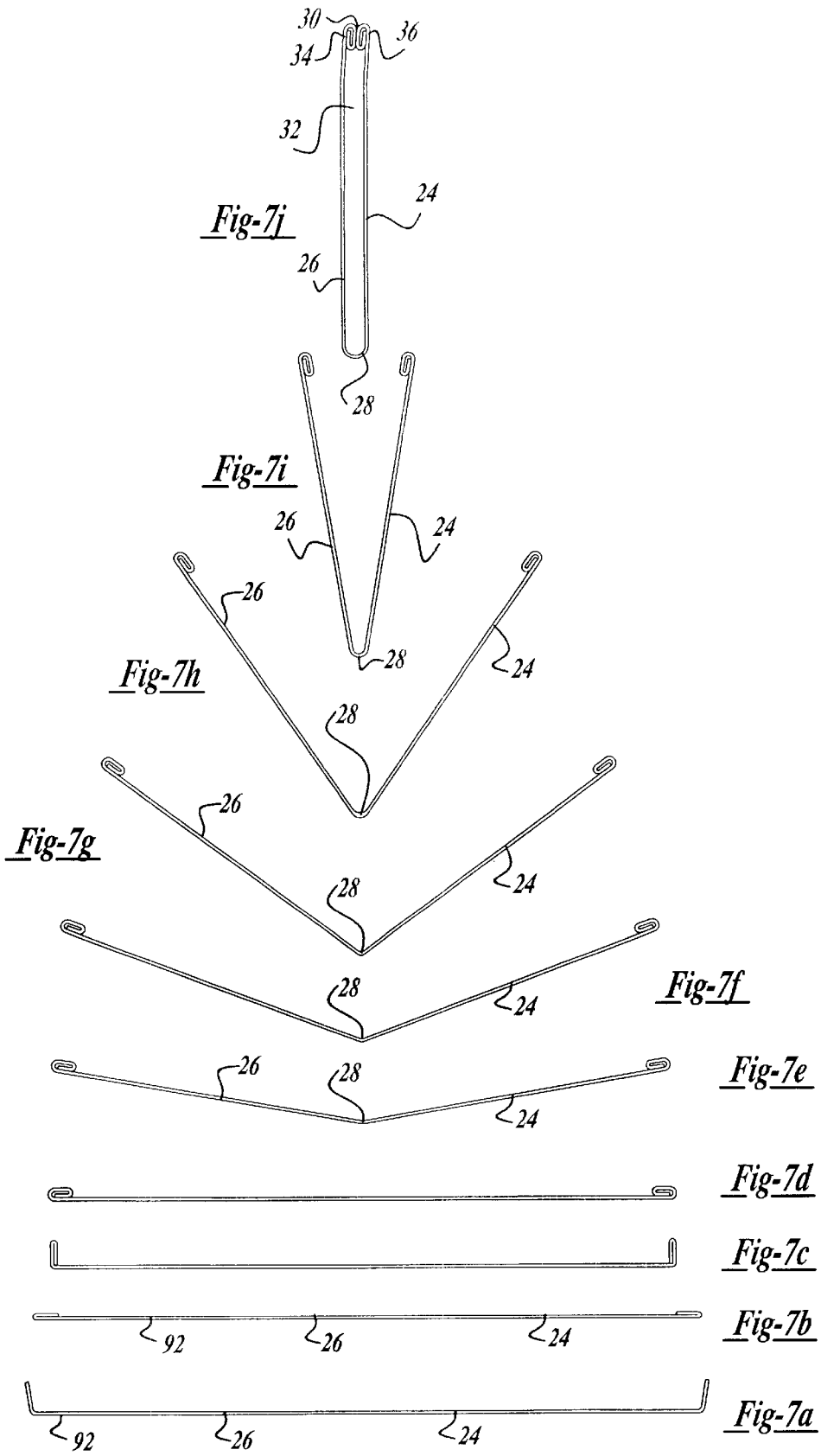
FIGS. 7A through 7L are views illustrating the steps of a method, according to the present invention, of making the tube with the flat turbulator of FIG. 1.
Figure 7L:
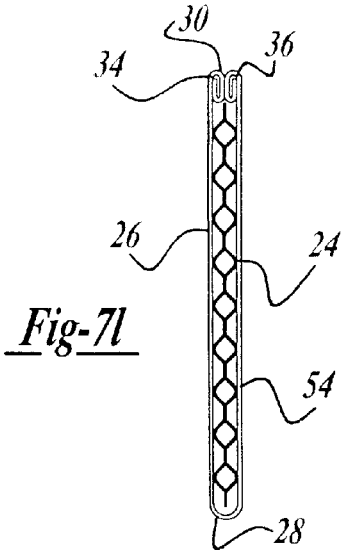
Figure 7K:
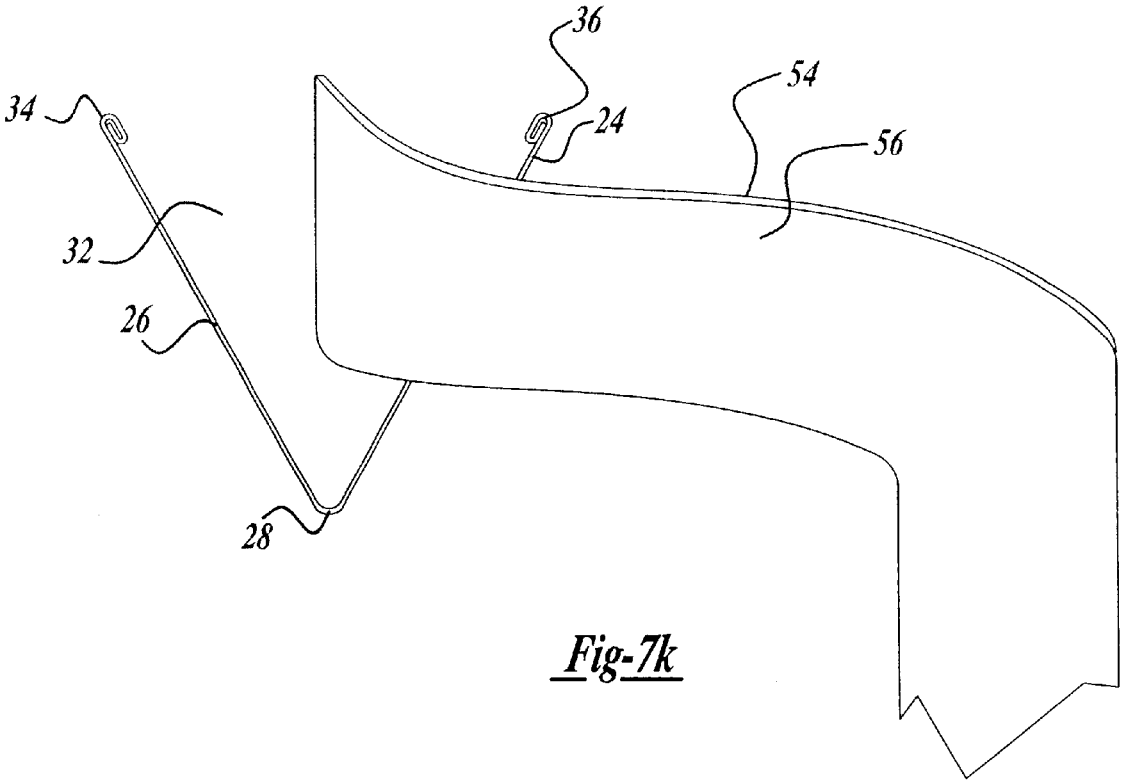

Referring to FIGS. 7A through 7L, a method of making the tube 12 with the flat turbulator 54, according to the present invention, is shown. The method includes the step of providing a generally planar sheet 92 having the base 24 and top 26 and the pair of terminal edges or ends 34 and 36 along a longitudinal length thereof. The method includes the step of folding the terminal ends 34 and 36 upwardly to form the second transition portions 42,50 and second flange portions 44,52 of the ends 34 and 36 as illustrated in FIG. 7A. The method also includes the step of folding the second flange portions 44,52 over to be generally parallel with the base 24 and top 26 as illustrated in FIG. 7B. The method includes the step of folding the terminal ends 34 and 36 upwardly to form the first transition portions 38,46 and first flange portions 40,48 of the ends 34 and 36 as illustrated in FIG. 7C. The method also includes the step of folding the first flange portions 40 and 48 over to be generally parallel with the base 24 and top 26 as illustrated in FIG. 7D. The method includes the step of folding the ends 34 and 36 of the sheet 92 toward each other in a series of progressive steps to form the first side 28 and top 26 and base 24 to oppose each other as illustrated in FIGS. 7E through 7I. The method includes the step of contacting the first end 34 and second end 36 with each other to form the channel 32 and second side 30 as illustrated in FIG. 7J. The method includes the step of separating the first end 34 and second end 36 by a knife (not shown) to open the channel 32 and feed the flat turbulator 54 into the channel 32 as illustrated in FIG. 7K. In this step, the flat turbulator 54 is fed from a generally horizontal position about a cone (not shown) to a generally vertical position into the channel 32. The method includes the step of closing the channel 32 by contacting the first end 34 and second end 36 together as illustrated in FIG. 7L. The method includes the step of brazing the tube 12 by heating the tube 12 to a predetermined temperature to melt the brazing material to braze the ends 32 and 34 and the corrugations 58 of the flat turbulator 54 to the base 24 and top 26. The tube 12 is then cooled to solidify the molten braze material to secure the ends 32 and 34 together and the corrugations 58 and the base 24 and top 26 together.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of making a flat turbulator for a heat exchanger comprising the steps of:

providing a generally planar strip having a base extending laterally and longitudinally;

roll forming a plurality of corrugations spaced laterally along the base and extending longitudinally a distance greater than a distance laterally, the corrugations extending generally perpendicular to the base in an alternating manner from opposed sides of the base such that the corrugations extend in a direction parallel to a longitudinal axis of the strip and with each adjacent alternating corrugations being spaced from one another such that the base extends between the adjacent alternating corrugations.

2. A method as set forth in claim 1 including the step of providing a pair of rollers and feeding the strip in a direction of rotation of the rollers to form the corrugations.

3. A method as set forth in claim 1 wherein said step of roll forming comprises forming a flat portion laterally between the corrugations.

4. A method as set forth in claim 1 wherein said step of roll forming comprises forming the corrugations with generally arcuate cross-sectional shape.

5. A method of making a tube for a heat exchanger comprising the steps of:

providing a planar sheet having a generally planar base and a pair of terminal ends along a longitudinal length thereof;

folding each of the terminal ends of the sheet to form a triple hem flange;

folding each of the terminal ends of the sheet toward one another until they meet to form a base, a top opposing the base, a first side interposed between the top and base and a second side interposed between said base to form a channel with free ends of the triple hem flange on each terminal end being disposed in the channel.

6. A method as set forth in claim 5 including the step of opening the channel and inserting a turbulator in the channel.

7. A method as set forth in claim 6 wherein said step of folding comprises folding each of the terminal ends in a vertical direction and moving the turbulator from a generally horizontal position to a generally vertical position and inserting the turbulator in the channel.

8. A method as set forth in claim 6 including the step of closing the channel after inserting the turbulator.

9. A method as set forth in claim 6 including the step of brazing the tube and turbulator together.

10. A method of making a flat turbulator for a heat exchanger comprising the steps of:

providing a generally planar strip having a base extending laterally and longitudinally;

providing a pair of rollers and feeding the strip in a direction of rotation of the rollers and roll forming a plurality of corrugations and a flat portion laterally between the corrugations in which the corrugations are spaced laterally along the base and extend longitudinally a distance greater than a distance laterally, the corrugations extending generally perpendicular to the base in an alternating manner from opposed sides of the base such that the corrugations extend in a direction parallel to a longitudinal axis of the strip and with each adjacent alternating corrugations being spaced from one another such that the flat portion extends between the adjacent alternating corrugations.

11. A method of making a heat exchanger comprising the step of:

providing a generally planar strip having a base extending laterally and longitudinally;

forming a plurality of corrugations spaced laterally along the base and extending generally perpendicular to the base in an alternating manner such that the corrugations extend in a direction parallel to a longitudinal axis of the strip to form a flat turbulator;

providing a planar sheet having a generally planar base and a pair of terminal ends along a longitudinal length thereof;

folding each of the terminal ends of the sheet to form a triple hem flange;

folding each of the terminal ends of the sheet toward one another until they meet to form a base, a top opposing the base, a first side interposed between the top and base and a second side interposed between said base to form a channel with free ends of the triple hem flange on each terminal end being disposed in the channel to form a tube; and separating the terminal ends to open the channel and inserting the flat turbulator into the channel of the tube.

* * * * *